US005678441A

United States Patent [19]

Schwarze

[11] Patent Number: 5,678,441

[45] Date of Patent: Oct. 21, 1997

[54] BENDING MACHINE FOR ELONGATE WORKPIECES

[76] Inventor: Rigobert Schwarze, Olpener Strasse 460-474, 51109 Cologne, Germany

[21] Appl. No.: 695,579

[22] Filed: Aug. 12, 1996

[30] Foreign Application Priority Data

Sep. 1, 1995 [DE] Germany ..... 195 32 261.4

[51] Int. Cl.[6] ..... B21D 7/04; B21D 9/05

[52] U.S. Cl. ..... 72/149; 72/155

[58] Field of Search ..... 72/149, 155, 157, 72/158, 159

[56] References Cited

U.S. PATENT DOCUMENTS 4,970,885 11/1990 Chipp et al. ..... 72/151

5,259,224 11/1993 Schwarze ..... 72/149

5,343,725 9/1994 Sabine ..... 72/155

FOREIGN PATENT DOCUMENTS 2304838 2/1973 Germany .

*Primary Examiner*—Lowell A. Larson

*Assistant Examiner*—Rodney Butler

*Attorney, Agent, or Firm*—Diller, Ramik & Wight, PC

[57] ABSTRACT

A bending machine for elongate workpieces, particularly a pipe bending machine, comprises a clamping jaw (18) for clamping the workpiece (14) to be bent. During the bending process, this clamping jaw (18) is advanced by a hydraulic piston-cylinder unit (24), the advance force being controlled to a predetermined value. In this manner, the workpiece (14) is subjected to a pressure bending process of high quality.

4 Claims, 2 Drawing Sheets

BENDING MACHINE FOR ELONGATE WORKPIECES

The present invention relates to a bending machine for elongate workpieces, and particularly to a pipe bending machine.

BACKGROUND OF THE INVENTION

Bending machines for elongate workpieces, which comprise also pipe bending machines, include a bending template having the workpiece pressed thereagainst by means of a clamping jaw so as to bend the workpiece. By turning the bending template, the workpiece is pulled around the bending template and thus is bent. A clamping means is provided to clamp the workpiece for holding it fixed in position. Said clamping means is arranged on a transport carriage which, during the bending process, is moved along by an advance drive means. Said advance drive means is usually provided as a rotary motor which, by means of a drive pinion, drives a toothed rack connected to the transport carriage. In such an arrangement, the advance drive means serves substantially only for the positioning of the workpiece relative to the bending template and for the holding and further advancement of the workpiece during the bending process.

During the bending process, the workpiece is preferably subjected to a positive advance force. In prior art bending machines, such an advance force is applied through the pipe supporting rail which laterally supports the unbent portion of the workpiece. To apply the advance force, said pipe supporting rail is driven in the advance direction of the workpiece. The force to be transmitted onto the workpiece depends on the friction between the surface of the workpiece and the pipe supporting rail. If the pipe supporting rail has a profiled surface to provide an improved grip, this profile will damage the surface of the workpiece. Further, it is known to mount an additional clamping element to the pipe supporting rail for clamping fixation of the workpiece on the pipe supporting rail. Such a clamping element, which is always mounted on the rear end of the pipe supporting rail, increases the residual clamping length for the bending of the last pipe.

It is an object of the invention to provide a bending machine for elongate workpieces which is suited to perform a pressure bending process with high technical quality and low technical expenditure.

SUMMARY OF THE INVENTION

According to the instant invention, the advance means for the transport carriage supporting the clamping means comprises at least one piston-cylinder unit, the pressure of said piston-cylinder unit being controlled to apply a predetermined advance force. Thus, by control of the pressure of the piston-cylinder unit, the advance force can either be kept constant over the complete advance path or be changed as provided by a specific program. Therefore, the advance means contributes to the bending process by pressing the workpiece material into the curvature, acting as a means for producing a positive advance pressure with a high power reserve. The advance force can be controlled either to be maintained constant, or to vary in dependence on the advance position of the transport carriage or on the rotational angle of the bending template.

When generating the last bend of the workpiece, the clamping means can be moved to a position close to the bending template, with the pipe supporting rail being shifted aside. In this situation, the function of the pipe supporting rail is taken over directly by the clamping means. Since the clamping means is urged forward with a controlled advance force, also such a short end portion will be bent (without the pipe supporting rail) with a controlled advance force.

In a preferred embodiment of the invention, a position detector is provided for detection of the actual position of the transport carriage. This position detector can be used for positional control of the transport carriage. Such a positional control is performed e.g. in the opened condition of the bending tools (bending template and clamping jaw) to bring the pipe, which is clamped by the clamping means, into a position suitable for bending, or, within a bending sequence, to position the pipe or other workpiece in the manner required for generating the next bend. In the position control process, the control circuit acts as a position control unit with underlying force limitation.

In the closed condition of the bending tools, on the other hand, a force control process is performed wherein the actual value of the advance force is adjusted to a desired value (which is constant or variable over time).

The use of hydraulic pressure converters in the supply and discharge lines of the piston-cylinder unit makes it possible to measure the pressure on both sides of the piston. These pressure values can be used, under consideration of the piston geometry, to detect the advance force. The advance speed is detected by the position detector.

A preferred embodiment of the invention will be explained in greater detail hereunder with reference to the accompanying drawings.

DETAILED DESCRIPTION OF A PREFERRED EMBODIMENT

Figure 1:
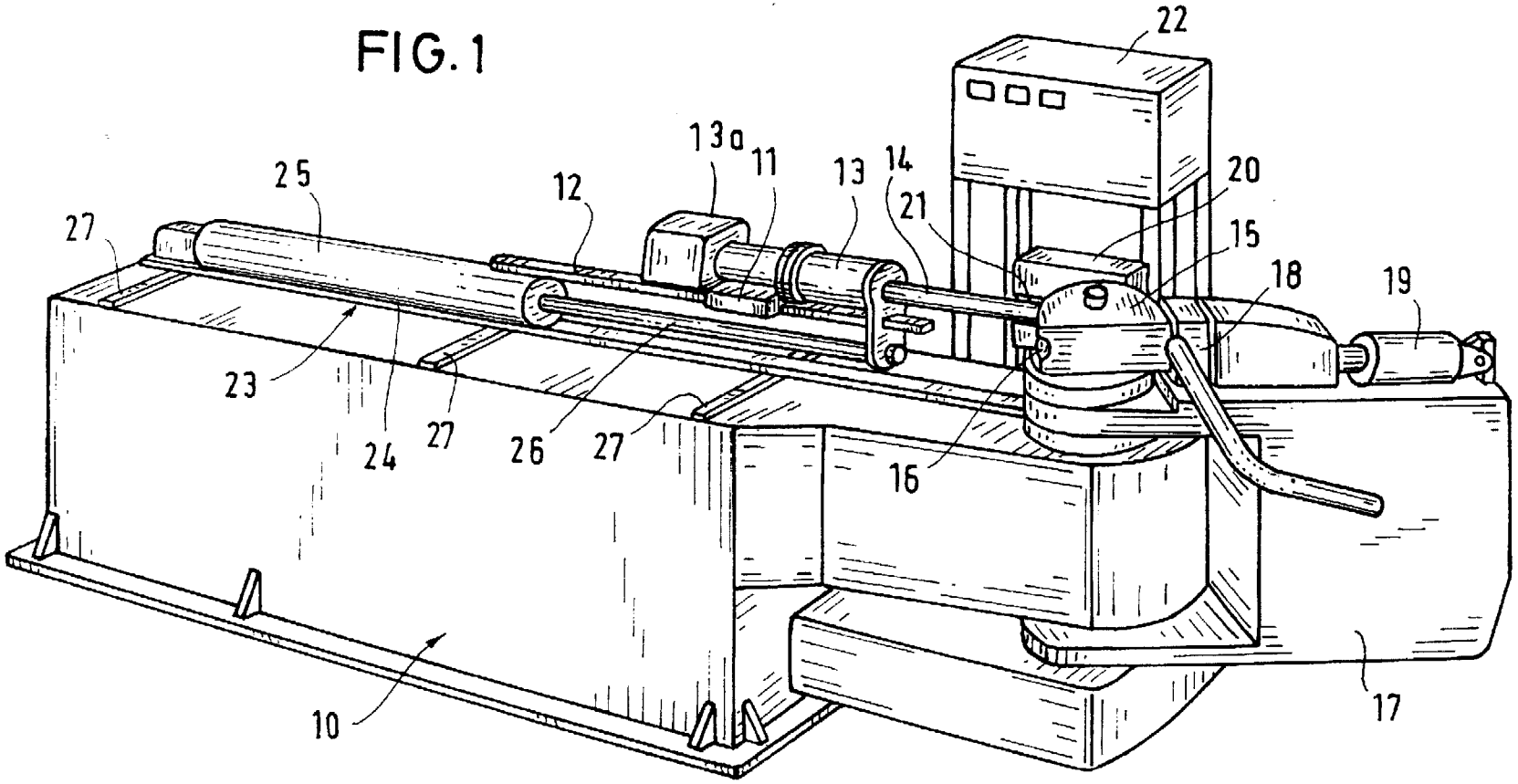
FIG. 1 shows a general perspective representation of the pipe bending machine.

The instant pipe bending machine comprises a machine bench 10 whereon a transport carriage 11 can be horizontally moved in a longitudinal direction along a guide means 12. Transport carriage 11 carries a clamping means 13 for clamping the pipe 14 to be bent. A rotary drive means **13*a* is operative to turn the clamping means 13 about its axis in a controlled manner so as to move the pipe 14 into the correct rotational position for the bending process. In addition to its movement along said guide means 12, transport carriage 11 can be set to a horizontal position also in the transverse direction of pipe 14** and be moved in height direction.

By moving the transport carriage 11, pipe 14 is laterally set against the bending template 15 which is rotatable about a vertical axis. Bending template 15 is provided on its periphery with a bending groove 16 formed to receive about half of the circumference of pipe 14. A pivot arm 17 is supported coaxially with bending template 15, carrying a clamping jaw 18 which, by a piston-cylinder unit 19, is pressed against bending template 15. Also clamping jaw 18 has a bending groove formed therein for receiving the other half of the circumference of pipe 14. In the bending process, clamping jaw 18 is first pressed against bending template 15, and then bending template 15 and pivot arm 17 are together turned or respectively pivoted about their axis, and the pipe is pulled around bending template 15 in the process.

To support the unbent pipe portion during the bending process, use is made of a pipe supporting rail 20 which also has a bending groove 21 formed therein. Pipe supporting rail 20 is moved together with pipe 14 while the pipe is pulled along during the bending process towards bending template 15.

All control processes of the pipe bending machine are numerically controlled and coordinated with each other through a control unit 22. This provision does not only apply to the moving sequence of the pipe bending process but also to the setting of the positions of transport carriage 11 and the bending tools, and to the turning and actuating of clamping sleeve 13.

The advance drive means 23 for advancing the transport carriage 11 comprises a piston-cylinder unit 24 including a hydraulic cylinder 25 supported on its rear end. The piston rod 26 can be extended to move out of hydraulic cylinder 25. Piston-cylinder unit 24 is guided on transverse rails 27 on machine bench 10 and can be displaced by a drive means (not shown). Guide means 12 is fixedly connected to cylinder 25. The front end of piston rod 26 is fixedly connected to transport carriage 11 so that transport carriage 11 will be displaced along guide means 12 corresponding to the respective extension length of piston rod 26.

Figure 2:
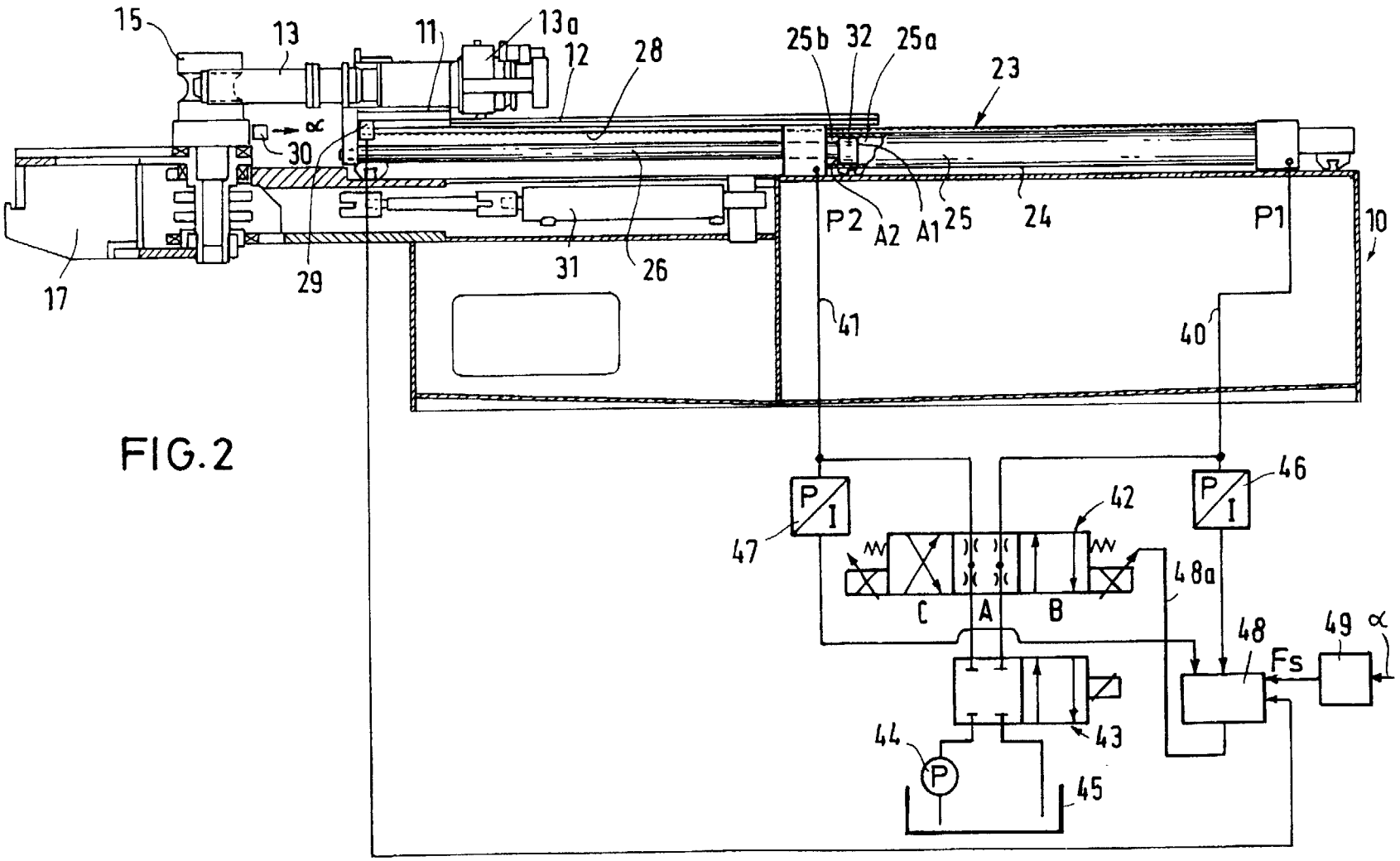
FIG. 2 shows a vertical longitudinal sectional view of the pipe bending machine according to FIG. 1.

As illustrated in FIG. 2, guide means 12 is provided with length markers 28 to be detected by a position sensor 29 attached to transport carriage 11. Position sensor 29 detects the respective position of transport carriage 11 along the length of guide means 12.

FIG. 2 further shows the position sensor 30 for detecting the rotational position of bending template 15 and outputting a corresponding rotational angle α. Bending template 15 is rotated, via a chain drive (not shown), by a hydraulic drive means 31 comprising two piston-cylinder units operative in opposite senses.

Advance cylinder 25 comprises a piston 32 connected to piston rod 26. The space within advance cylinder 25 is divided by piston 32 into a working chamber **25*a* and a return stroke chamber 25*b*. The working chamber 25*a* is connected to a conduit 40, and the return stroke chamber 25*b* is connected to a conduit 41**.

The conduits 40 and 41 are connected to a control valve 42 arranged to be switched between three different positions A, B and C. In position A as illustrated in FIG. 2, valve 42, which can be switched between an open position and a closed position, will connect the conduits 40 and 41 to a switching valve 43 leading to a pump 44 and a sump 45. Position B of valve 42 serves for the fast advance movement and position C for the return stroke of piston 32.

In position A of control valve 42, the flow cross-sections of the passages to conduits 40 and 41 are changed proportionately to the signal from a control line **48*a*. If the signal of control line 48*a* is small, also the throttle cross-section connected to conduit 40 and the throttle cross-section connected to conduit 41 are small. The larger the signal of control line 48*a* is, the larger the throttle cross-section connected to conduit 40 and the throttle cross-section connected to conduit 41** will be. The throttle cross-sections in the supply and discharge passages are always identical. The pressures on both sides of the piston are changed in opposite senses to each other.

Conduit 40 is connected to a pressure converter 46 provided to generate an electric signal which corresponds to the hydraulic pressure in conduit 40. Conduit 41 is connected to a pressure converter 47 provided to generate an electric signal which corresponds to the hydraulic pressure in conduit 41. The outlets of said two pressure converters 46 and 47 are connected to a control unit 48 delivering the control signal for the differential valve 42 to control line **48*a*. From the pressures in the chambers 25*a* and 25*b* and the sizes of the two piston surfaces A1 and A2, control unit 48 computes the desired value Fi of the advance force acting on transport carriage 11**.

Control unit 48 is further connected to a desired-value generator 49 delivering to control unit 48 a desired value Fs of the advance force. Said desired value Fs of the advance force is varied e.g. in dependence on the rotational angle α of bending template 15 emitted by position sensor 30.

Said desired-value generator 49 has a plurality of curves stored therein, indicating the desired value Fs of the press-on force as depending on the rotational angleα of bending template 15. The respective desired curve can be selected through the desired-value generator 49. Desired-value generator 49 will output, in dependence on α, the respective associated desired value Fs, from which the actual value Fi is subtracted. This control device, which is provided e.g. as a PID controller, delivers—via control line **48*a*—a control signal to the controlled system which in the instant case consists of differential valve 42 and piston-cylinder unit 24**.

The pressure P1 in conduit 40 and the pressure P2 in conduit 41 are supplied to the respective converter 46 or 47. The output signal of converter 46 is multiplied by a value corresponding to the surface area A1 of piston 32. The output signal of converter 47 is multiplied by a value corresponding to the surface area A2 of piston 32. In this manner, the products P1×A1 und P2×A2 are generated. Each of these products is a measure for one of the two forces acting on piston 32 in opposite senses. The two products are subtracted from each other, resulting in the actual value Fi of the advance force. This actual value is subtracted from the desired value Fs to generate the control signal for the control valve 48.

Further, control unit 48 receives the position signal of position sensor 29 detecting the position of transport carriage 11. Control unit 48 can be switched into an operational mode "position control" wherein it will set the position of transport carriage 11 to a predetermined target value. This is the case e.g. in the opened condition of the bending tools when the pipe is to be positioned on the bending template 15 to perform a bending process. When the bending tools have been subsequently moved into their closed position, control unit 48 is switched into an operational mode "force control" wherein the pressure in the working chamber **25*a* of advance cylinder 25** is controlled in a manner to adjust the advance force to the desired value.

I claim:

1. A bending machine for bending an elongate workpiece comprising clamping means (13) for clamping a trailing portion of a workpiece (14) which is to be bent, rotary drive means (**13*a*) for rotating said clamping means (13) to rotate the workpiece (14), a rotatably driven bending template (15), clamping means (18) for pressing a leading portion of the workpiece (14) against said bending template (15), a transport carriage (11) carrying said clamping means (13), advance drive means (23) for moving said transport carriage (11) and therewith moving said clamping means (13) supporting rail means (20) for laterally supporting an unbent portion of the workpiece, said advance drive means (23) includes hydraulic piston-cylinder means (24) for applying a controlled predetermined hydraulic advancing force to said transport carriage (11) to thereby effect controlled movement of said clamping means (13), means (46, 47, 48) for detecting the actual value (Fi) of the advance force generated by the piston-cylinder means (24), and a control unit (48) for controlling the actual value (Fi) of the advance force corresponding to a desired value (Fs) delivered by a desired-value generator (49**).

2. The bending machine according to claim 1 wherein said desired-value generator (49) defines said desired value (Fs) in dependence on the rotational angle ($\alpha$) of the bending template (15) or in dependence on the advance position of the transport carriage (11).

3. The bending machine according to claim 1 wherein said means for detecting the actual value (Fi) of the advance force comprise two pressure sensors (46,47) detecting the pressure values on both sides of the piston (32) of the piston-cylinder unit (24).

4. The bending machine according to claim 1 wherein said control unit (48) is provided to control a control valve (42) with a continuous throttle characteristic, said control valve (42) controlling the pressure values on both sides of the piston (32) in opposite senses.

* * * * *